US011787661B2

(12) United States Patent
Sonnenmoser et al.

(10) Patent No.: US 11,787,661 B2
(45) Date of Patent: Oct. 17, 2023

(54) METHOD FOR MOVING AN ELEVATOR CAR OF AN ELEVATOR FOR EVACUATING PASSENGERS AND BRAKE OPENING DEVICE FOR MOVING AN ELEVATOR CAR OF AN ELEVATOR FOR EVACUATING PASSENGERS

(71) Applicant: Inventio AG, Hergiswil (CH)

(72) Inventors: Astrid Sonnenmoser, Hochdorf (CH); Ivo Lustenberger, Buttisholz (CH); Thomas Hartmann, Kleinwangen (CH)

(73) Assignee: INVENTIO AG, Hergiswil (CH)

( * ) Notice: Subject to any disclaimer, the term of this patent is extended or adjusted under 35 U.S.C. 154(b) by 170 days.

(21) Appl. No.: 17/309,681

(22) PCT Filed: Dec. 20, 2019

(86) PCT No.: PCT/EP2019/086694

§ 371 (c)(1),
(2) Date: Jun. 15, 2021

(87) PCT Pub. No.: WO2020/127982

PCT Pub. Date: Jun. 25, 2020

(65) Prior Publication Data

US 2022/0055861 A1 Feb. 24, 2022

(30) Foreign Application Priority Data

Dec. 20, 2018 (EP) ..... 18214614

(51) Int. Cl.
*B66B 5/02* (2006.01)
*B66B 5/16* (2006.01)

(52) U.S. Cl.
CPC ..... *B66B 5/027* (2013.01); *B66B 5/16* (2013.01)

(58) Field of Classification Search
CPC ..... B66B 5/02; B66B 5/027; B66B 5/0031; B66B 1/32; B66B 5/16; B66B 5/06; B66B 5/04; B66B 1/3492; B66B 1/30
See application file for complete search history.

(56) References Cited

U.S. PATENT DOCUMENTS 4,083,430 A * 4/1978 Gingrich ..... H03M 1/285 187/394
6,264,005 B1 7/2001 Kang et al.
2023/0022982 A1* 1/2023 Bewersdorf ..... B66B 5/027

FOREIGN PATENT DOCUMENTS

CN 1320549 A 11/2001
CN 106744127 A * 5/2017 ..... B66B 5/0031
(Continued)

*Primary Examiner* — Marlon T Fletcher
(74) *Attorney, Agent, or Firm* — William J. Clemens; Shumaker, Loop & Kendrick, LLP

(57) ABSTRACT

A method for moving an elevator car of an elevator for evacuating passengers from the elevator car in the event of a power failure, wherein a brake blocks a vertical movement of the elevator car, includes the steps of: applying an electrical pulse or a plurality of electrical pulses to the brake of the elevator car to release the brake and unblock the vertical movement of the elevator car, the brake being released for as long as the particular electrical pulse is applied to the brake; determining a covered height which the elevator car has covered during the application of the particular electrical pulse; comparing the determined covered height with a predetermined distance; and terminating the application of the particular electrical pulse to the brake when the determined covered height is equal to or greater than the predetermined distance.

15 Claims, 2 Drawing Sheets

(56) References Cited

FOREIGN PATENT DOCUMENTS

| | | | | | |
|---|---|---|---|---|---|
| CN | 108333962 | A | * | 7/2018 | ..... B66B 1/28 |
| CN | 108946369 | A | * | 12/2018 | ..... B66B 1/308 |
| EP | 3216735 | A1 | * | 9/2017 | |
| EP | 3216735 | A1 | | 9/2017 | |
| EP | 3239087 | A1 | | 11/2017 | |
| JP | S5917477 | A | | 1/1984 | |
| JP | 2011195270 | A | | 10/2011 | |
| JP | 2017114599 | A | | 6/2017 | |
| KR | 20100004695 | A | | 1/2010 | |
| WO | WO-2011148411 | A1 | * | 12/2011 | ..... B66B 1/3492 |
| WO | WO-2018008220 | A1 | * | 1/2018 | ..... B66B 1/32 |
| WO | WO-2019105797 | A1 | * | 6/2019 | ..... B66B 5/027 |
| WO | WO-2020127982 | A1 | * | 6/2020 | ..... B66B 5/027 |

* cited by examiner

METHOD FOR MOVING AN ELEVATOR CAR OF AN ELEVATOR FOR EVACUATING PASSENGERS AND BRAKE OPENING DEVICE FOR MOVING AN ELEVATOR CAR OF AN ELEVATOR FOR EVACUATING PASSENGERS

FIELD

The present invention relates to a method for moving an elevator car of an elevator for evacuating passengers and to a brake opening device for moving an elevator car of an elevator for evacuating passengers.

BACKGROUND

Methods for moving an elevator car to evacuate passengers from an elevator car in the event of a power failure are known. For example, EP 3 216 735 A1 describes a method in which the brake of an elevator car is gradually released after a power failure in order to move the elevator car to a floor. The electrical pulses for releasing the brake always have the same size or length of time, for example a duration of 270 ms at intervals of 1000 ms.

The disadvantage of this is that since the elevator car moves very slowly or not at all, depending on the weight ratios between the counterweight and the elevator car with people or passengers, a large number of electrical pulses are necessary to move the elevator car significantly. It can therefore take a very long time until the elevator car has been moved to a height at which the people or passengers can leave the elevator car.

SUMMARY

There may be a need, inter alia, for a method for moving an elevator car of an elevator for evacuating passengers and a brake opening device for moving an elevator car of an elevator for evacuating passengers in the event of a power failure, in which method and device the elevator car can be moved technically simply and quickly with a small number of pulses to a height at which the passengers can leave the elevator car.

Such a need can be met by a method for moving an elevator car of an elevator for evacuating passengers and a brake opening device for moving an elevator car of an elevator for evacuating passengers, respectively, according to the advantageous embodiments that are defined in the following description.

According to a first aspect of the invention, a method for moving an elevator car of an elevator for evacuating passengers from the elevator car of the elevator in the event of a power failure, in which method a brake blocks a vertical movement of the elevator car, is proposed, the method comprising the following steps: applying an electrical pulse or a plurality of electrical pulses to the brake of the elevator car in order to release the brake and unblock the vertical movement of the elevator car, the brake being released for as long as the particular electrical pulse is applied to the brake; determining a covered height (difference formation with respect to the height of the elevator car at the beginning of the application of the electrical pulse) which the elevator car has covered during and thus since the beginning of the application of the particular electrical pulse; comparing the determined covered height with a predetermined distance; and terminating the application of the particular electrical pulse to the brake when the determined covered height is equal to the predetermined distance or greater than the predetermined distance.

The advantage of this is that typically the period or time span of the electrical pulse for opening the brake, during which the brake is open, is not a predetermined period or time span, but the period or time span of the electrical pulse or the application of the electrical pulse to the brake is variable and depends on the distance covered by the elevator car in height (i.e. along the elevator shaft). The elevator car can thus generally move the same distance with people or passengers regardless of the weight ratios between the counterweight and the weight of the elevator car during the application of the electrical pulse for releasing the brake. Consequently, the elevator car can usually be moved with a particularly small number of electrical pulses by a significant distance and moved to a level or height at which the persons or passengers can safely leave the elevator car (e.g. at the height of a floor). In addition, the comfort of the passengers in the elevator car typically increases, since the number of times the brake is opened and closed is reduced. In addition, the passengers can generally be evacuated from the elevator car within a short time. In addition, the effort required to evacuate the passengers from the elevator car is typically reduced.

According to a second aspect of the invention, a brake opening device is proposed for moving an elevator car of an elevator for evacuating passengers from the elevator car of the elevator in the event of a power failure, where a brake blocks a vertical movement of the elevator car, the brake opening device comprising the following: a pulse-generating device for applying an electrical pulse or a plurality of electrical pulses to the brake of the elevator car in order to release the brake and unblock the vertical movement of the elevator car, the brake being released for as long as the particular electrical pulse is applied to the brake, and a determination device for determining a covered height of the elevator car which the elevator car has covered during the application of the particular electrical pulse, and for comparing the determined covered height with a predetermined distance, the brake opening device being designed such that the application of the particular electrical pulse to the brake is terminated when the determined covered height is equal to the predetermined distance or greater than the predetermined distance.

Possible advantages of the brake opening device correspond analogously to the above-described advantages of the method specified above.

According to a third aspect of the invention, an elevator for passengers is proposed, the elevator comprising an elevator car for accommodating the passengers and a brake opening device as described above.

Possible features and advantages of embodiments of the invention may be considered, inter alia and without limiting the invention, to be dependent upon the concepts and findings described below.

As already stated in the introduction, in the event of a power failure, passengers must be evacuated from the elevator car of an elevator. In the event of a power failure, the elevator car is often not at a level or a height along the elevator shaft at which the passengers can safely leave the elevator car after opening the door or doors of the elevator car.

In the event of a power failure, the elevator car is usually braked or blocked by one or more brakes, which are closed without current, so that vertical movement along the elevator shaft is not possible as long as the brake or brakes is/are closed. In order to move the elevator car, the brake or brakes is/are thus released by applying an electrical pulse to the brakes once or several times, which opens the particular brake. During the electrical pulse, the brake typically remains in the opened state, so that the elevator car can move.

In the prior art, the lengths of the electrical pulses are the same, i.e. each electrical pulse has the same length. However, during the particular electrical pulse the elevator car may move very slowly, so that the movement in height or the distance covered in height per electrical pulse is only very small. Therefore, in the prior art the movement by a significant distance (e.g. a few centimeters or a few dozen centimeters) may take a very long time. Consequently, with conventional approaches it may take a very long time until the elevator car has been moved to a level or a height at which the passengers can safely leave the elevator car or can be evacuated after opening the door or doors.

The above-mentioned problems or deficits in conventional approaches are addressed by embodiments of the method presented herein for moving an elevator car of an elevator for evacuating passengers from the elevator car of the elevator and of the brake opening device presented herein for moving an elevator car of an elevator for evacuating passengers from the elevator car of the elevator.

In the method presented herein and the brake opening device presented herein, the distance covered along the elevator shaft or along the height is a termination criterion for terminating the application of the electrical pulse or the release of the brake. As soon as a predetermined distance or height has been covered by the elevator car during an electrical pulse (i.e. when the predetermined distance is reached or exceeded), the electrical pulse or the application of the electrical pulse is terminated, so that the brake is closed again and the brake stops or brakes the elevator car.

As explained in the context of the embodiments, in addition to the termination criterion of covering the predetermined distance, there may be further termination criteria for terminating the application of the electrical pulse to the brake, which criteria may occur earlier than the termination criterion of covering the predetermined distance.

According to an embodiment of the method, a speed of the elevator car during the vertical movement during the application of the particular electrical pulse is determined and the speed of the elevator car is compared with a predetermined speed, the application of the particular electrical pulse to the brake being terminated when the determined speed is equal to the predetermined speed or greater than the predetermined speed.

In other words, in this embodiment, reaching or exceeding a predetermined speed can be a further termination criterion for the application of the electrical pulse to the brake. The application of the electrical pulse to the brake can thus be terminated as soon as either the determined distance has reached or exceeded the predetermined distance, or the determined speed has reached or exceeded the predetermined speed.

This typically prevents the elevator car from reaching too high a speed in a technically simple manner. This would generally lead to large negative accelerations when braking the elevator car which, under unfavorable circumstances, could negatively affect the comfort or health of the passengers in the elevator car. In addition, the brake for braking the elevator car is generally conserved as a result, since the forces that occur when braking the elevator car can be kept particularly low. Moreover, this prevents the brake from being overstrained or failing at high speeds, i.e. when the brake is operated outside the intended operating parameters.

According to an embodiment of the method, a period since the application of the particular electrical pulse to the brake for releasing the brake is determined and the determined period is compared with a predetermined period, the application of the particular electrical pulse to the brake being terminated when the determined period is equal to the predetermined period or greater than the predetermined period.

In other words, in this embodiment, a predetermined period elapsing can be a further termination criterion for the application of the electrical pulse to the brake. The application of the electrical pulse to the brake can thus be terminated as soon as either the determined distance has reached or exceeded the predetermined distance, or the determined period has reached or exceeded the predetermined period. It is possible that the application of the electrical pulse to the brake is terminated as soon as either the determined distance has reached or exceeded the predetermined distance, the determined speed has reached or exceeded the determined speed, or the determined period has reached or exceeded the predetermined period.

The advantage of this is that the elevator car is typically not moved in one piece or uninterruptedly for too long. This increases typically the comfort of the passengers in the elevator car, who otherwise could get the impression that the brake has failed, which could cause fear among the passengers.

According to an embodiment of the method, the electrical pulse is a square pulse.

In other words, in this embodiment, the electrical pulse always has its maximum value or its minimum value. Values in between can generally only occur briefly.

This typically conserves the brake or the material of the brake since the brake is completely opened as soon as the electrical pulse is applied.

According to an embodiment of the method, the electrical pulse is a voltage pulse.

In other words, in this embodiment, the electrical pulse can have an increased voltage value (e.g. a high voltage for opening the brake compared to a low voltage or zero voltage for closing the brake). The electrical pulse can thus include the application of an increased voltage to the brake.

The advantage of this is that the brake can usually be constructed in a technically particularly simple manner. In addition, the electrical pulse can generally be generated in a technically particularly simple manner.

According to an embodiment of the method, the electrical pulse is generated by a controller, in particular a microcontroller.

In other words, in this embodiment, a controller can apply the electrical pulse to the brake or a controller can generate the electrical pulse.

An advantage of this is that the electrical pulse can generally be generated in a technically particularly simple and reliable manner.

According to an embodiment of the brake opening device, the brake opening device is designed to determine a speed of the elevator car during the vertical movement during the application of the particular electrical pulse and to compare the determined speed of the elevator car with a predetermined speed, the brake opening device being designed such that the application of the electrical pulse to the brake is terminated when the determined speed is equal to the predetermined speed or greater than the predetermined speed.

In other words, the brake opening device in this embodiment can have a further termination criterion for the application of the electrical pulse to the brake. The application of the electrical pulse can be terminated when either the determined distance is equal to or greater than the predetermined distance or the determined speed is equal to or greater than the predetermined speed.

This can generally ensure, in a technically simple manner, that the elevator car does not reach or exceed too high a speed. Too high a speed of the elevator car when the application of the electrical pulse is terminated can typically lead to high negative accelerations when braking the elevator car. Under unfavorable circumstances, this could negatively affect the comfort or health of the passengers in the elevator car. Another advantage of this embodiment of the brake opening device is that the brakes for braking the elevator car are usually conserved, since the forces that occur when braking the elevator car can be kept particularly low.

According to an embodiment of the brake opening device, the brake opening device is designed to determine a period since the application of the particular electrical pulse to the brake for releasing the brake and to compare the determined period with a predetermined period, the brake opening device being designed such that the application of the particular electrical pulse to the brake is terminated when the determined period is equal to the predetermined period or greater than the predetermined period.

In other words, in this embodiment of the brake opening device, there can be a further termination criterion which, when fulfilled, causes the application of the electrical pulse to be terminated. The brake opening device can thus terminate the application of the electrical pulse to the brake as soon as either the determined distance has reached or exceeded the predetermined distance or the determined period has reached or exceeded the predetermined period. It is possible for the brake opening device to terminate the application of the electrical pulse to the brake as soon as either the determined distance has reached or exceeded the predetermined distance, the determined speed has reached or exceeded the determined speed, or the determined period has reached or exceeded the predetermined period.

The advantage of this is that the elevator car is generally not moved by the brake opening device in one piece or uninterruptedly for too long. This increases typically the comfort of the passengers in the elevator car, who otherwise could get the impression that the brake has failed, which could cause fear among the passengers.

According to an embodiment of the brake opening device, the electrical pulse is a square pulse.

In other words, the electrical pulse can have the shape of a rectangle, i.e. the value of the electrical pulse can have either its maximum value or its minimum value, i.e. zero.

As a result, the brake or the material of the brake can generally be conserved, since the brake is completely opened when the electrical pulse is applied.

According to an embodiment of the brake opening device, the electrical pulse is a voltage pulse.

In other words, in this embodiment, the application of the electrical pulse can comprise increasing the voltage applied to the brake. The electrical pulse can thus have an increased voltage.

The advantage of this is that the brake can usually be constructed in a technically particularly simple manner. In addition, the electrical pulse can generally be generated in a technically particularly simple manner.

According to an embodiment of the brake opening device, the pulse generating device comprises a controller, in particular a microcontroller.

In other words, in this embodiment, the electrical pulse can be generated by a controller or microcontroller.

An advantage of this is that the electrical pulse can typically be generated in a technically particularly simple and reliable manner. In addition, the brake opening device can usually be designed to be particularly inexpensive. The controller or microcontroller is often available anyway for other tasks in controlling the elevator.

The distance covered by the elevator car during the particular electrical pulse can be determined or measured in different ways. For example, the distance can be determined by means of a magnetic tape with position information, the magnetic tape extending along the height of the elevator shaft. The height position of the elevator car can be determined by reading out the information on the magnetic tape at the particular height at which the elevator car is currently located. By forming the difference between the height at the beginning of the application of the electrical pulse and at the termination of the application of the electrical pulse, the distance or height covered since the application of the electrical pulse can be determined. Another possibility for determining the distance or height covered is for the height of the elevator car to be determined by laser measurement or laser distance measurement. For this purpose, the elevator car can have one or more laser devices for emitting a laser beam in the direction of the floor of the elevator shaft and/or in the direction of the ceiling of the elevator shaft. The height of the elevator car or the distance of the elevator car from the floor or ceiling can be determined by measuring the time of flight and/or by interference. By forming the difference with respect to the height of the elevator car at the beginning of the application of the electrical pulse, the height or distance covered during the application of the electrical pulse can be determined. The covered distance can be determined with a particularly high degree of certainty or reliability. This means that there can be a plurality of checking levels or processes, so that the distance or height covered by the elevator car can be determined with a particularly high level of reliability. Errors in determining the height or the covered distance can thus be substantially ruled out.

The speed of the elevator car can be determined or measured in different ways. For example, the speed can be determined by means of the determined distance per unit of time (e.g. distance per second). It is also conceivable that the speed of the elevator car along the height is determined via the rotational speed of a disk or the like for moving the elevator car in height. The speed can also be determined using particularly reliable means. The determined speed can thus have a particularly high level of reliability.

The period since the application of the particular electrical pulse can be determined or measured in different ways. For example, a timer or an oscillator, e.g. a quartz oscillator or a piezo oscillator, with a predetermined frequency can be used to determine the period. The timer or oscillator can be a device having particularly high reliability. Errors in determining the period and/or in determining the speed are thus substantially ruled out.

It should be noted that some of the possible features and advantages of the invention are described herein with reference to different embodiments of the method for moving an elevator car of an elevator for evacuating passengers from the elevator car of the elevator and to the brake opening device for moving an elevator car of an elevator for evacuating passengers from the elevator car of the elevator. A person skilled in the art recognizes that the features can be combined, adapted, or replaced as appropriate in order to arrive at further embodiments of the invention.

Embodiments of the invention will be described in the following with reference to the accompanying drawings, with neither the drawings nor the description being intended to be interpreted as limiting the invention.

The drawings are merely schematic and not true to scale. Like reference signs refer to like or equivalent features in the various drawings.

DETAILED DESCRIPTION

Figure 1A:
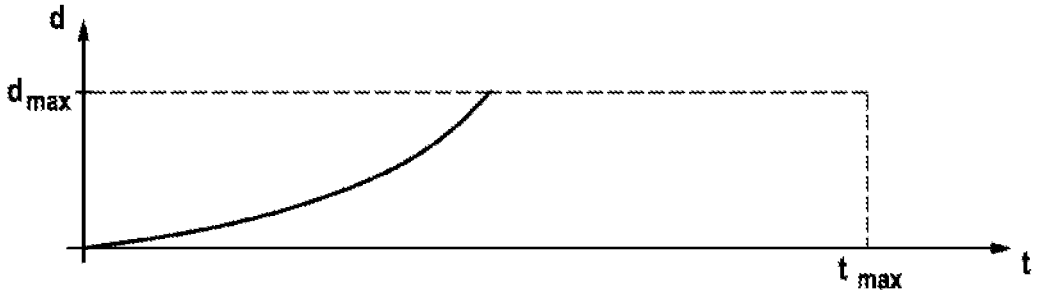
FIG. 1*a* is a distance-time diagram for a first embodiment of the method according to the invention.
Figure 1B:
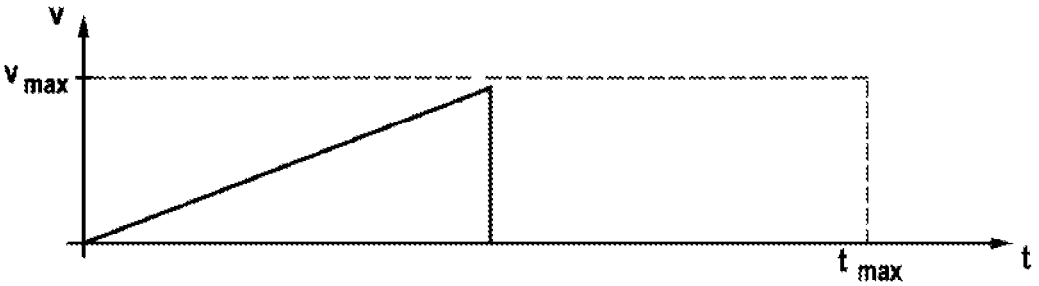
FIG. 1*b* is a speed-time diagram for the first embodiment of the method according to the invention.

FIG. 1 is a distance-time diagram for a first embodiment of the method according to the invention. FIG. 1*b* is a speed-time diagram for the first embodiment of the method according to the invention.

In the event of a power failure, the elevator car 10 of an elevator 5 (see FIG. 4) is automatically braked by a brake 18 or a plurality of brakes and further movements of the elevator car 10 along the height of the elevator shaft 15 are blocked. The brake 18 or brakes are de-energized in the locked or blocked state. If the elevator car 10 has not been braked to the height of a floor, the elevator car 10 must be moved to the height or level of a floor or some other exit option so that the passengers can be evacuated from the elevator car 10 or can safely leave the elevator car 10.

For this purpose, the brake 18 (or the brakes) of the elevator car 10 is repeatedly released by electrical pulses, so that the elevator car 10 can move gradually along the height of the elevator shaft 15 during the particular release of the brake 18. The electrical pulses are usually triggered manually, i.e. by an operator or maintenance person.

While the electrical pulse is applied or being applied to the brake 18, the brake 18 remains opened and the elevator car 10 can move by gravity. Alternatively or additionally, the elevator car 10 can be weighted with weights and/or pulled with cables in the direction of the elevator shaft 15.

The electrical pulse can be applied to the brake 18 or generated by a controller or a microcontroller. The controller can be a controller or microcontroller which takes on further tasks for controlling the movement of the elevator car 10 in normal circumstances. However, it is also conceivable that a special controller or microcontroller is present. The pulse-generating device 30 or the controller can be a device with a particularly high level of reliability, so that errors when applying the electrical pulse or when terminating the electrical pulse are substantially ruled out. In particular, individual components of the pulse-generating device 30 or the controller, or of an entire brake opening device 20 formed therewith, can be designed as safe components that, for example, meet a safety integrity level (SIL) SIL-2, SIL-3 or even SIL-4, e.g., as defined in IEC 61508 published by the International Electrotechnical Commission.

The length of time or the periods or time spans of the electrical pulses can be of different sizes.

The electrical pulse can be a voltage pulse. This means that the voltage which is applied to the brake 18 during the electrical pulse is higher than the voltage which is applied to the brake 18 outside of the electrical pulse. However, it is also conceivable that the electrical pulse is a current pulse.

The electrical pulse can in particular be a square pulse. This means that the electrical pulse is either at its maximum level or at its minimum level (e.g. zero level). Values in between occur only very briefly, if at all.

The electrical pulse can thus be a square voltage pulse.

It is also possible that the electrical pulse is the interruption of a current signal or voltage signal, the current signal or the voltage signal normally being applied to the brake 18 during the power failure. The electrical pulse then interrupts the current signal or voltage signal which ensures the closure of the brake 18, and in this way opens the brake 18.

The brake opening device 20 comprises a pulse-generating device 30 and a determination device 40. The pulse-generating device 30 is designed for applying the electrical pulse to a brake 18 of the elevator car 10 to release the brake 18, the brake 18 being released for as long as the electric pulse is applied to the brake 18. The determination device 40 is designed to determine or detect a distance covered by the elevator car 10 during a vertical movement of the elevator car 10 while the particular electrical pulse is being applied to the brake 18. The speed of the elevator car 10 can also be determined or calculated by means of the determination device 40. It is also possible for the determination device 40 to determine the period since the application of the electrical pulse. The brake opening device 20 can function as a pulse electric brake opening device (PEBO).

The application of the electrical pulse to the brake 18 is terminated when the elevator car 10 has moved a predetermined distance $d_{max}$ along the elevator shaft 15 while the brake 18 is released by the application of the electrical pulse. After the application of the electrical pulse to the brake 18 has been terminated, the brake 18 closes again and thus brakes the elevator car 10 so that the elevator car 10 can no longer move until the brake 18 is released again.

In FIG. 1*a*, the time t is plotted on the x-axis and the distance d covered by the elevator car 10 along the elevator shaft 15 is plotted on the y-axis. As soon as the predetermined distance $d_{max}$ (also referred to as the maximum distance) has been covered by the elevator car 10 during the release of the brake 18 by applying a single electrical pulse, the application of the electrical pulse is terminated. As a result, the elevator car 10 is stopped by the brake 18. It is also possible that the application of the electrical pulse is not terminated until the predetermined distance is exceeded.

In FIG. 1*b*, the time t is plotted on the x-axis and the speed v of the elevator car 10 along the height or along the elevator shaft 15 is plotted on the y-axis.

After the application of the electrical pulse has been terminated, a predetermined or variable pause can follow in which no electrical pulse is applied to the brake 18. During this pause, the brake 18 remains in the blocked state. The variable pause can depend, for example, on how long the brake 18 was opened during the immediately preceding electrical pulse. If the brake 18 has been open for a longer period of time, the pause until the next electrical pulse can be longer. The variable pause can also depend on the distance covered during the immediately preceding electrical pulse. It is also conceivable that the variable pause depends on the distance covered within a given period of time (e.g. within the last minute).

The speed v of the elevator car 10 increases somewhat faster than linearly in FIG. 1*b*.

The course of the distance covered by the elevator car 10 shown in FIG. 1*a* and in FIG. 1*b* is typical when the weight of the counterweight of the elevator is much greater than the weight of the elevator car 10 with passengers.

Figure 2A:
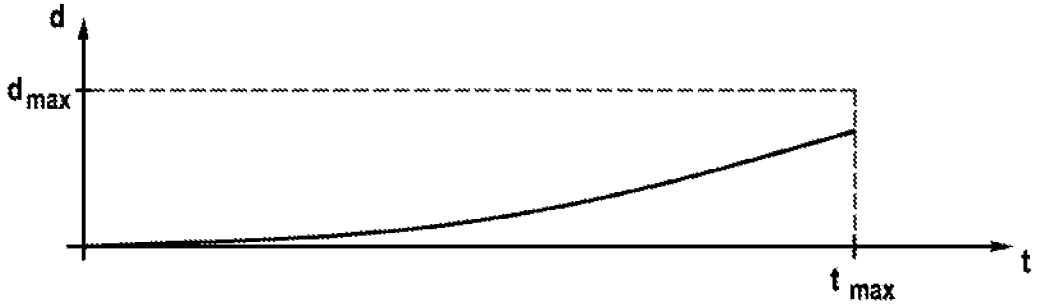
FIG. 2*a* is a distance-time diagram for a second embodiment of the method according to the invention.
Figure 2B:
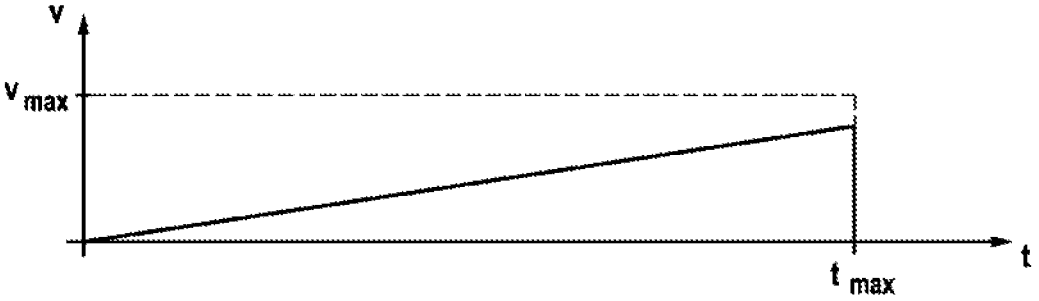
FIG. 2*b* is a speed-time diagram for the second embodiment of the method according to the invention.

FIG. 2*a* is a distance-time diagram for a second embodiment of the method according to the invention. FIG. 2*b* is a speed-time diagram for the second embodiment of the method according to the invention.

In FIG. 2*a*, the time t is plotted on the x-axis and the distance d covered by the elevator car 10 along the elevator shaft 15 is plotted on the y-axis. In FIG. 2*b*, the time t is plotted on the x-axis and the speed v of the elevator car 10 along the height or along the elevator shaft 15 is plotted on the y-axis.

A further termination condition for the termination of the electrical pulse can be present in the method or the brake opening device 20, namely that a predetermined maximum period $t_{max}$ or time span has been reached. This means that the maximum period or time span of the application of the electrical pulse is $t_{max}$. The brake 18 is therefore not opened for longer than $t_{max}$. This means that the application of the electrical pulse is terminated when the elevator car 10 has covered the predetermined maximum distance $d_{max}$ while the brake 18 is being opened or when the electrical pulse was applied to the brake 18 (at least) for the period or time span $t_{max}$. When at least one of these two termination conditions is met, the application of the electrical pulse is terminated in the method or the brake opening device 20.

For this purpose, the time that has elapsed since the electrical pulse was applied is detected or determined and compared with the predetermined period $t_{max}$. The further termination condition is fulfilled when the specific period is equal to or greater than the predetermined period $t_{max}$.

The maximum or predetermined period or time span $t_{max}$ can, for example, be in the seconds range, for example 10 s. This ensures that the elevator car 10 does not move in height for longer than the period or time span $t_{max}$ in one go, i.e. without interruption. This consequently ensures that the passengers in the elevator car 10 are not frightened. With a release of any length or very long release of the brake 18, i.e. until the predetermined distance $d_{max}$ has necessarily been covered, the passengers could, under unfavorable circumstances, get the impression that the brake 18 is no longer working.

In the course shown in FIGS. 2*a* and 2*b*, the elevator car 10 is accelerated only very slowly and moves at a correspondingly low speed. The predetermined maximum distance $d_{max}$ is not covered during the electrical pulse. Nonetheless, the electrical impulse is terminated, since the maximum period or time span of the electrical pulse $t_{max}$ has been reached.

The course shown in FIG. 2*a* and in FIG. 2*b* occurs in particular when the weight of the elevator car 10 with passengers substantially corresponds to the weight of the counterweight.

The elevator car 10 can move up or down along the elevator shaft 15. This depends on the weight of the elevator car 10 with passengers compared to the weight of the counterweight. Further factors here are additional weights for moving the elevator car 10 and/or cables for moving the elevator car 10 if it does not move significantly on its own.

Figure 3A:
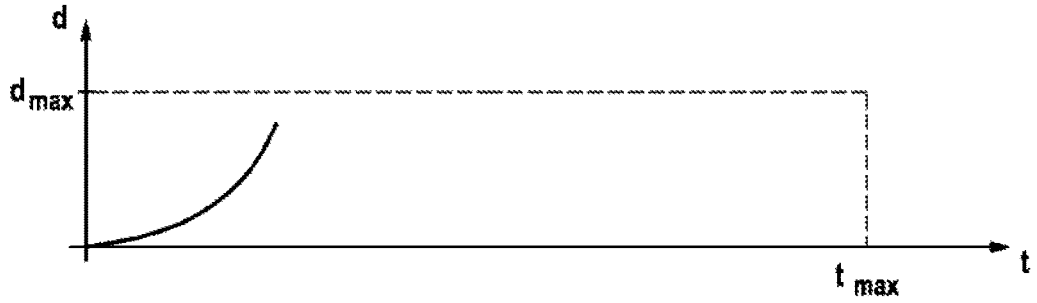
FIG. 3*a* is a distance-time diagram for a third embodiment of the method according to the invention.
Figure 3B:
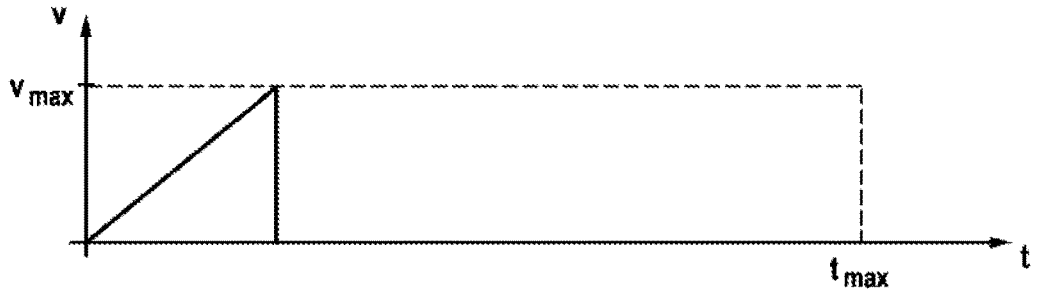
FIG. 3*b* is a speed-time diagram for the third embodiment of the method according to the invention.

FIG. 3*a* is a distance-time diagram for a third embodiment of the method according to the invention. FIG. 3*b* is a speed-time diagram for the third embodiment of the method according to the invention.

In FIG. 3*a*, the time t is plotted on the x-axis and the distance d covered by the elevator car 10 along the elevator shaft 15 is plotted on the y-axis. In FIG. 3*b*, the time t is plotted on the x-axis and the speed v of the elevator car 10 along the height or along the elevator shaft 15 is plotted on the y-axis.

A further termination condition can be the speed reached by the elevator car 10. When the speed of the elevator car 10 along the elevator shaft 15 reaches or has reached or exceeded a predetermined maximum speed or predetermined speed $v_{max}$, the electrical pulse is terminated. As can be clearly seen in FIG. 3*b*, the electrical pulse or the application of the electrical pulse is terminated, although the predetermined distance $d_{max}$, as can be seen in FIG. 3*a*, has not yet been covered.

This prevents the elevator car 10 from reaching too high a speed. This protects the brake 18 when the application of the electrical pulse is terminated. In addition, this limits the maximum negative acceleration that acts on the passengers in the elevator car 10 when braking the elevator car 10 when the brake 18 is closed.

It is possible that only the two termination conditions of covering the predetermined distance $d_{max}$ and the elapse of the predetermined period $t_{max}$ or time span of the application of the electrical pulse apply. It is also possible that only the two termination conditions of covering the predetermined distance $d_{max}$ and reaching the predetermined speed $v_{max}$ apply. With both of these possibilities, the electrical pulse is terminated as soon as one of the two termination conditions is met.

It is also possible that all three termination conditions apply at the same time, i.e. the termination conditions of covering the predetermined distance $d_{max}$, the elapse of the predetermined period $t_{max}$ or time span of the application of the electrical pulse, and reaching the predetermined speed $v_{max}$. As soon as at least one of the termination conditions is fulfilled, the electrical pulse or the application of the electrical pulse to the brake 18 is terminated.

The predetermined distance $d_{max}$ can be 10 cm or 5 cm, for example. The predetermined maximum speed $v_{max}$ can be 0.1 m/s, for example. The predefined period $t_{max}$ or time span can be 10 s, for example.

There can be a time span of, for example, 0.5 s or 1 s between the electrical pulses.

Figure 4:
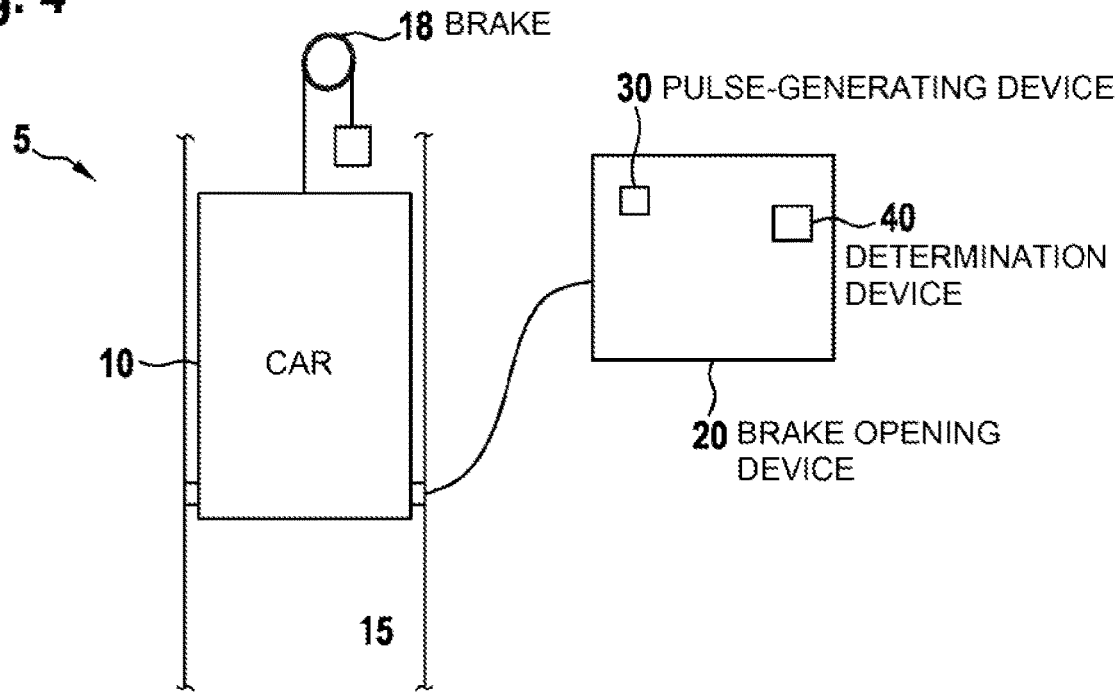
FIG. 4 is a schematic view of an embodiment of the elevator according to the invention.

FIG. 4 is a schematic view of an embodiment of the elevator 5 according to the invention. The elevator 5 comprises an elevator car 10 for accommodating the passengers and a brake opening device 20 having the pulse generating device 30 and the determination device 40. The brake opening device 20 is connected via a connecting line to an electrical brake 18 of the elevator car 10, which can move up and down in the elevator shaft 15 when the brake 18 is released. In the de-energized state (i.e. also in the event of a power failure) the brake 18 is closed and brakes the elevator car 10. The brake 18 can be opened by the brake opening device 20 by means of an electrical pulse and remains open during the application of the electrical pulse. The duration of the application of the electrical pulse is determined by the distance covered by the elevator car 10 during the application of the electrical pulse. In addition, a predetermined speed (maximum speed) and/or the elapse of a predetermined period can determine the duration of the application of the electrical pulse.

The brake opening device 20 can be arranged in a technical space of the elevator 5. The application of an electrical pulse to the brake 18 can be triggered or started manually by an operator or technician, for example, by actuating an evacuation button of the brake opening device 20. The application of the electrical pulse is terminated when a termination condition (distance traveled) or a plurality of the termination conditions described above is/are fulfilled. The evacuation button can be pressed repeatedly until the elevator car 10 has moved gradually to a level or height at which the passengers can be safely evacuated from the elevator car 10. This can be indicated, for example, by an optical signal (LED) and/or an acoustic signal. The door or doors of the elevator car 10 can now be opened, and therefore the passengers can safely leave the elevator car 10.

During the power failure of a main supply, the brake opening device 20 can be supplied with power from a power supply independent of the main supply and/or from a generator.

Finally, it should be noted that terms such as "comprising," "having," etc. do not preclude other elements or steps and terms such as "a" or "an" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A method for moving an elevator car of an elevator for evacuating passengers from the elevator car in an event of a power failure, wherein a brake blocks a vertical movement of the elevator car, the method comprising the steps of:

applying an electrical pulse to the brake of the elevator car to release the brake and unblock vertical movement of the elevator car, wherein the brake is released for as long as the electric pulse is applied to the brake;

determining a covered height of vertical movement that the elevator car has covered during the application of the electrical pulse;

comparing the determined covered height with a predetermined distance; and terminating the application of the electrical pulse to the brake when the determined covered height is equal to or greater than the predetermined distance.

2. The method according to claim 1 including determining a speed of the elevator car during the vertical movement, comparing the speed of the elevator car with a predetermined speed, and terminating the application of the electrical pulse to the brake when the determined speed is equal to or greater than the predetermined speed.

3. The method according to claim 1 including determining a period since the application of the electrical pulse to the brake, comparing the determined period with a predetermined period, and terminating the application of the electrical pulse to the brake when the determined period is equal to or greater than the predetermined period.

4. The method according to claim 1 wherein the electrical pulse is a square pulse.

5. The method according to claim 1 wherein the electrical pulse is a voltage pulse.

6. The method according to claim 1 including generating the electrical pulse using a controller.

7. The method according to claim 1 including generating the electrical pulse using a microcontroller.

8. A brake opening device for moving an elevator car of an elevator for evacuating passengers from the elevator car in an event of a power failure by opening a brake blocking a vertical movement of the elevator car, the brake opening device comprising:

a pulse generating device adapted to apply an electrical pulse to the brake to release the brake and unblock the vertical movement of the elevator car, wherein the brake is released for as long as the electric pulse is applied to the brake;

a determination device determining a covered height of vertical movement of the elevator car that the elevator car has covered during the application of the electrical pulse; and wherein the brake opening devices compares the determined covered height with a predetermined distance and terminates the application of the electrical pulse to the brake when the determined covered height is equal to or greater than the predetermined distance.

9. The brake opening device according to claim 8 wherein the brake opening device determines a speed of the elevator car during the vertical movement, compares the determined speed of the elevator car with a predetermined speed, and terminates the application of the electrical pulse to the brake when the determined speed is equal to or greater than the predetermined speed.

10. The brake opening device according to claim 8 wherein the brake opening device determines a period since the application of the electrical pulse to the brake, compares the determined period with a predetermined period, and terminates the application of the electrical pulse to the brake when the determined period is equal to or greater than the predetermined period.

11. The brake opening device according to claim 8 wherein the electrical pulse is a square pulse.

12. The brake opening device according to claim 8 wherein the electrical pulse is a voltage pulse.

13. The brake opening device according to claim 8 wherein the pulse generating device is a controller.

14. The brake opening device according to claim 8 wherein the pulse generating device is a microcontroller.

15. An elevator for carrying passengers, the elevator comprising:

an elevator car accommodating the passengers;

a brake blocking a vertical movement of the elevator car; and the brake opening device according to claim 8 operating the brake.

* * * * *